US006155564A

United States Patent [19]

Tsai

[11] Patent Number: 6,155,564

[45] Date of Patent: Dec. 5, 2000

[54] AIR SYSTEM STRUCTURE OF ROTARY GAME TABLE

[76] Inventor: Peter Tsai, 3F, No. 18, Shi-Jei Street, Hsinchu-City, Taiwan

[21] Appl. No.: 09/394,129

[22] Filed: Sep. 10, 1999

[51] Int. Cl.[7] ..... A63F 7/07

[52] U.S. Cl. ..... 273/108.1; 273/119 R; 273/108.52; 273/126 R; 273/441

[58] Field of Search ..... 273/108.41, 108.5, 273/108.51, 108.52, 108.53, 18.54, 108.55, 108.56, 108.57, 118 R, 119 R, 126 R, 126 A, 284, 108.1, 123 R, 124 A, 118 A, 457, 456, 441, 454, 460, 461, 108

[56] References Cited

U.S. PATENT DOCUMENTS

| | | |
|---|---|---|
| 3,722,888 | 3/1973 | Ducharme . |
| 3,773,325 | 11/1973 | Crossman . |
| 3,931,974 | 1/1976 | Goldfarb . |
| 3,954,267 | 5/1976 | Freeman . |
| 4,076,242 | 2/1978 | Joseph . |
| 4,082,282 | 4/1978 | Trbovich . |
| 5,356,143 | 10/1994 | Hyiak . |
| 5,467,985 | 11/1995 | Jones . |
| 5,605,328 | 2/1997 | Rudell . |
| 5,630,760 | 5/1997 | Brown . |
| 5,752,886 | 5/1998 | Tien . |
| 5,788,231 | 8/1998 | To . |
| 6,003,866 | 12/1999 | Tsai . |

*Primary Examiner*—Sebastiano Passaniti
*Attorney, Agent, or Firm*—Pro-Techtor International Services

[57] ABSTRACT

An air system with an improved structure used in a rotary game table of the game table machine is disclosed. The rotary game table is pivoted on a game table base and has two different game table structures for table soccer and hockey table on the top and bottom surfaces of the game table plate, respectively. An electric fan is hidden in the goal frame of the game table for table soccer to provide sufficient air stream for hockey table to float the ball. The goal is used as an air inlet to reduce the vertical thickness of the rotary game table. The manufacturing cost and delivery cost are also decreased because of simpler structure and less material used.

4 Claims, 4 Drawing Sheets

AIR SYSTEM STRUCTURE OF ROTARY GAME TABLE

FIELD OF THE INVENTION

The present invention relates to an improved air system, and more particularly, to an air system used in a rotary game table which includes two different game table structures on the top and bottom surfaces of a single game table plate, including table soccer and hockey table. An electric fan is hidden in the goal frame of the game table for table soccer and provides sufficient air stream for hockey table to float the ball. The goal is used as an air inlet to reduce the vertical thickness of the rotary game table. The manufacturing cost and delivery cost are also decreased because of simpler structure and less material used in the present invention.

BACKGROUND OF THE INVENTION

Some game table bases used in the game table machine have been developed for domestic recreation in the modern society, including table soccer, hockey table, billiards, and so forth. Those game machines cost higher and require considerable space to install. Therefore, a lot of manufacturers integrated two appropriate game machines into a single machine according to inherent characteristics so as to provide the user with more recreation by playing one of the two game in one machine. For example, table soccer and hockey table are integrated on the top and bottom surfaces of the game table plate, respectively. However, it is required for the tradition machine to pull up and then rotate the game table base by hand to switch to another game on the bottom side.

Some disadvantages of the tradition machine with such a structure combining table soccer and hockey table are described as follows:

1. More space is required for the game table machine to implement the air system which hockey table needs to supply sufficient air stream on the surface of the bottom plate to float the ball such that the user can hit the ball into the goal. A plurality of air chambers are formed in the bottom plate for hockey table, each air chamber having a plurality of fine pores. An electric fan is connected with the back surface of the bottom plate to appropriately inject air to form air stream on the bottom plate. The whole game table structure includes three layers, the fist layer having table soccer, the second layer accommodating the fan, and the third layer having hockey table.
2. It is inconvenient to pull up and then rotate the game table by hand to switch to another game on the bottom side instead of only directly rotating the machine.
3. The vertical thickness of the game table can not reduced and the delivery cost is higher because of huge size.

Therefore, it has been greatly needed to implement a game table machine, which has a game table with smaller size and more convenient operation to switch to another game without pulling up the machine by hand.

SUMMARY OF THE INVENTION

An object of the present invention is to provide an improved air system of a rotary game table built with hockey table and table soccer on the top and bottom surfaces of the game table plate. An electric fan is provided at one corner of the back of the game table for hockey table and hidden in the goal of the game table pale for table soccer such that the vertical thickness and the whole volume of the rotary table are greatly reduced.

Another object of the present invention is to provide a rotary game table, which allows the user easily to switch to another game by directly rotating the rotary game table.

A further object of the present invention is to provide a rotary game table with a simpler, more easily manufactured, and lower cost structure.

Other features and advantages of the invention will become apparent from the following description of the invention which refers to the accompanying drawings.

DETAILED DESCRIPTION OF THE PREFERRED EMBODIMENTS

Figure 1:
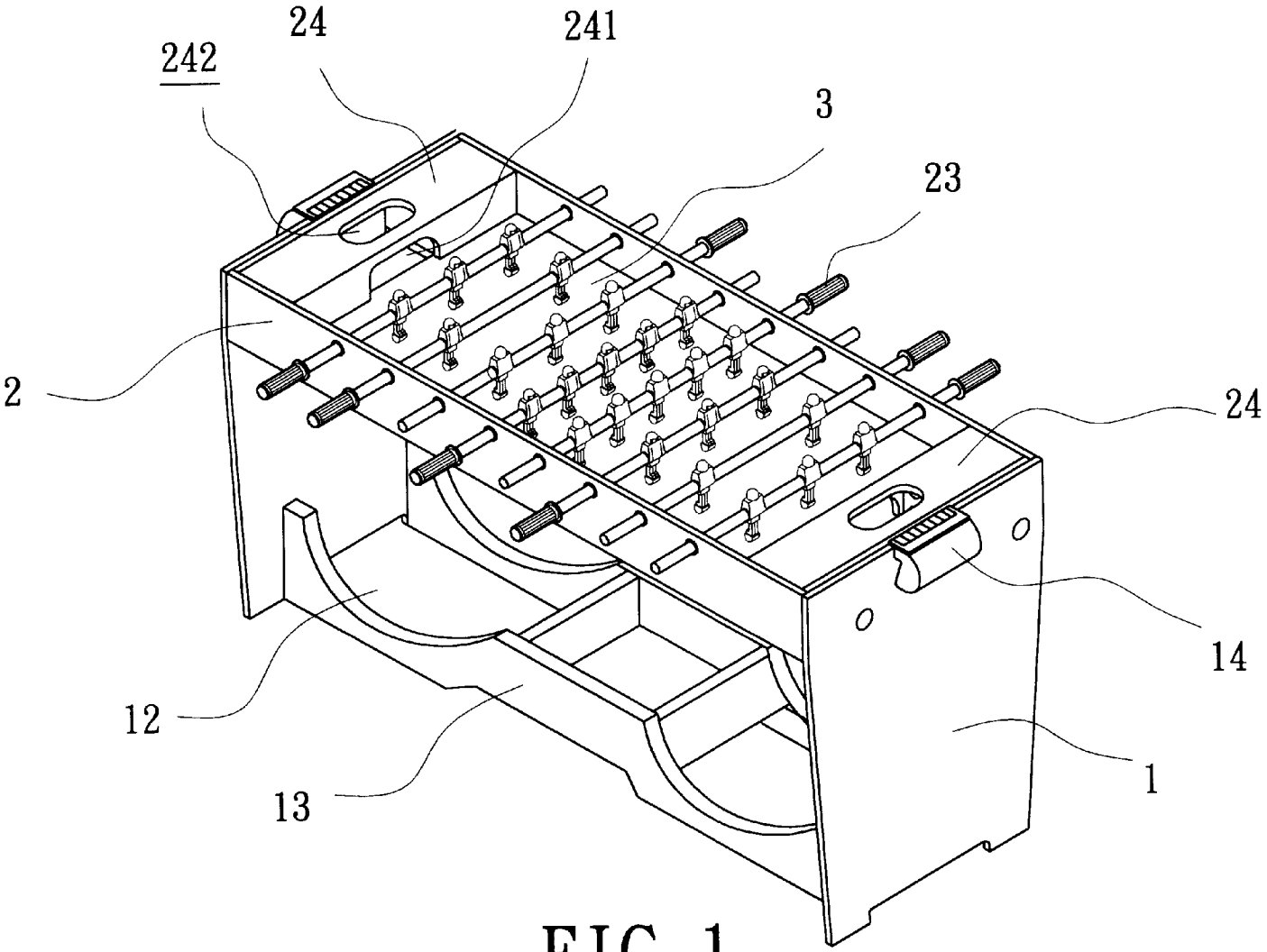
FIG. 1 shows a three-dimensional view of a game table machine for table soccer according to the present invention.
Figure 2:
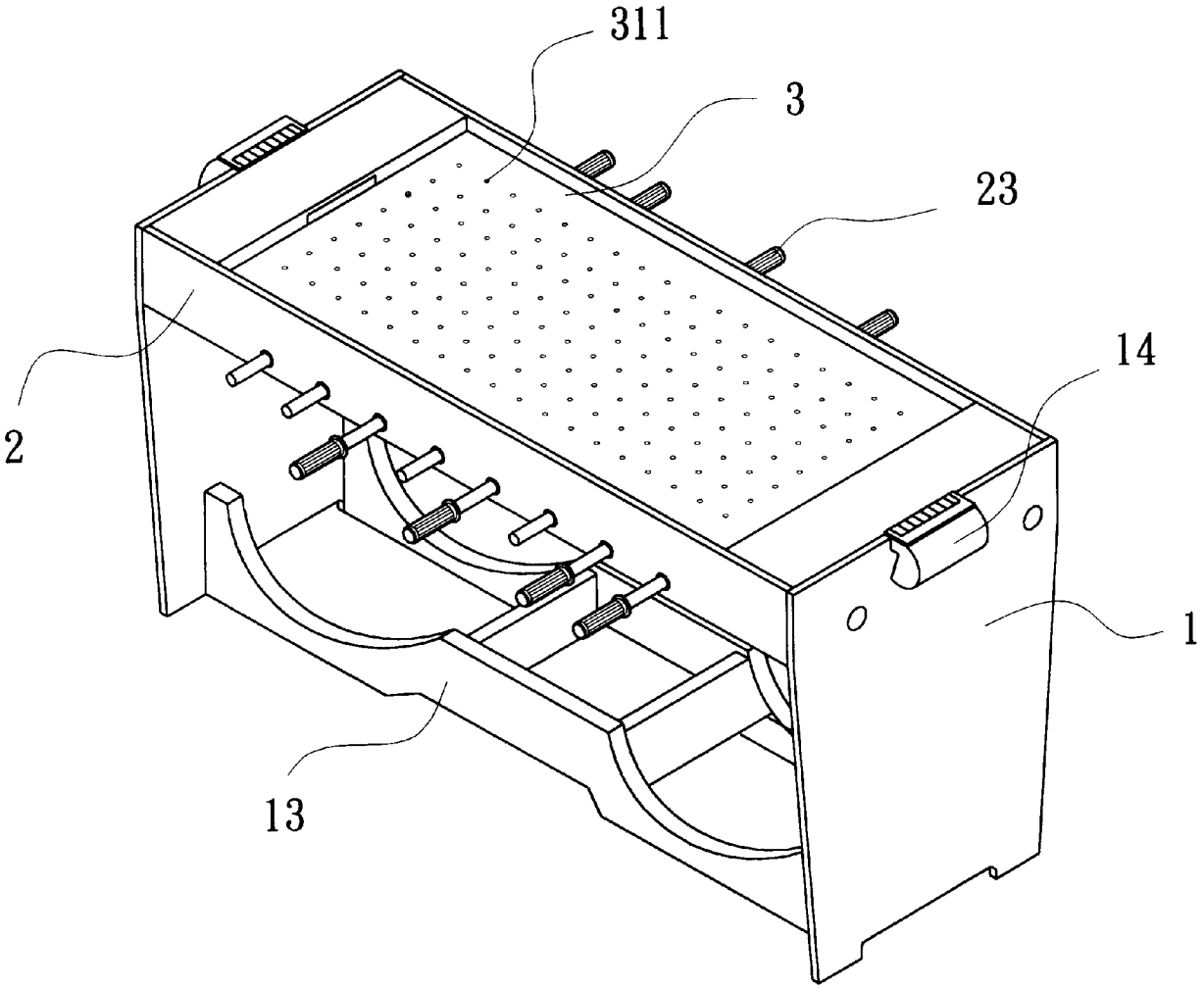
FIG. 2 shows a three-dimensional view of a game table machine for hockey table according to the present invention.

With reference to FIGS. 1 and 2, showing a three-dimensional view of the game table machine of the present invention, the game table machine consists of a game table base 1, a rotary game table 2, and a game table plate 3. The rotary game table 2, which provides two different game tables on the top and bottom surfaces of the game table plate 3, includes hockey table (in FIG. 1) and table soccer (in FIG. 2). Therefore, the vertical thickness and the whole volume of the rotary table are greatly reduced and it is easier to manufacture the machine at lower cost. Furthermore, the delivery cost is also reduced.

Figure 3:
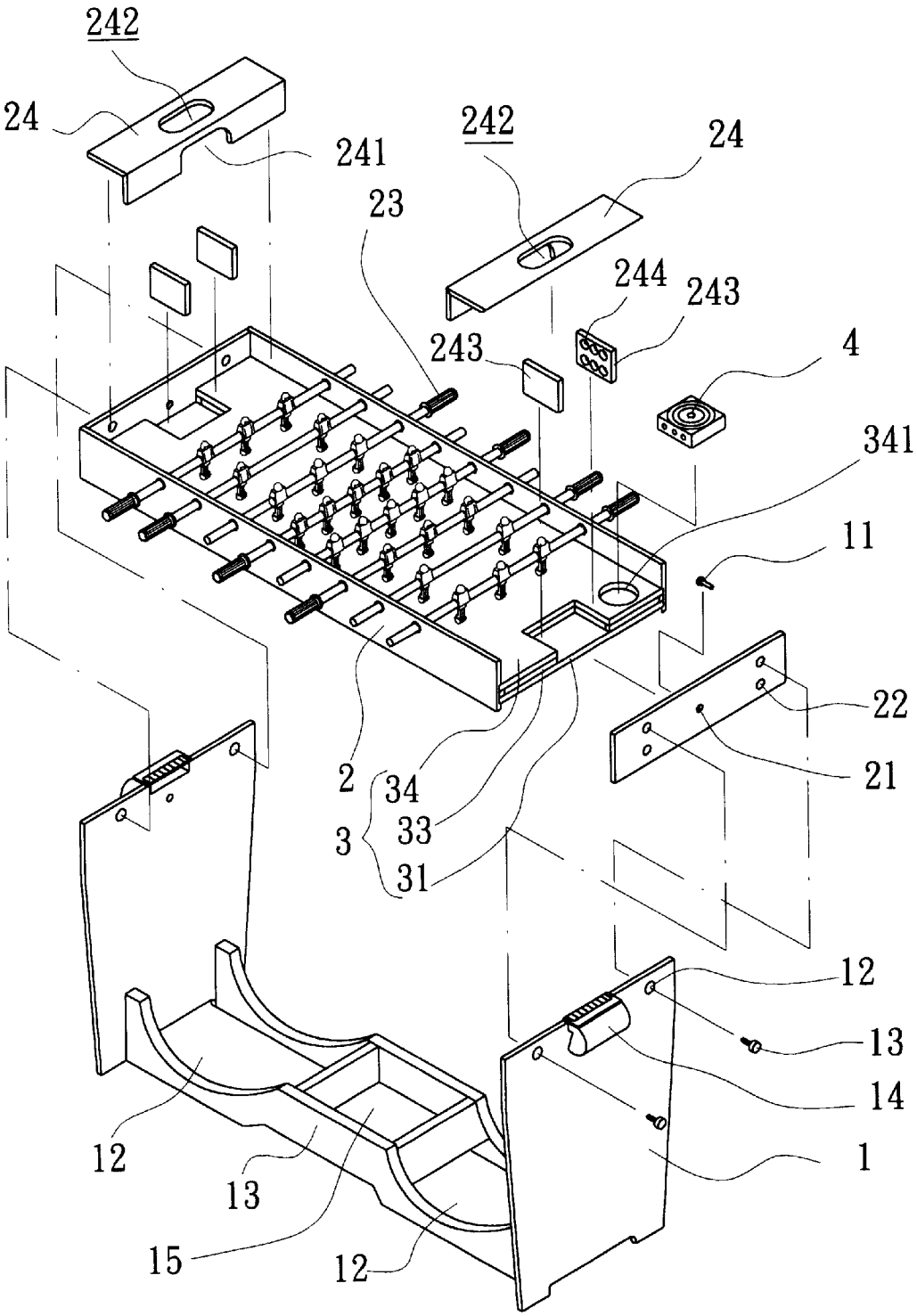
FIG. 3 is an exploded diagram of game table machine of the present invention.

The rotary game table 2 provides two different games on the top and bottom surfaces of the game table plate 3, including hockey table and table soccer, as shown in FIG.3. There are two goal frames 24 on two opposite sides of the game table for table soccer, respectively. Each goal frame 24 has a goal 241 and a ball outlet 242. The ball which was hit into the goal 241 can be taken out through the ball outlet 242. Two baffle plates 243 are used to form the goal 241. One baffle plate 243 has a plurality of air inlets 244 used as pass channels for the fan 4 which is hidden in the goal frame 24 of the game table plate 3. The fan 4 provides sufficient air stream to float the ball used in hockey table on another game table. The present invention hides the fan 4 in another goal frame 24 of the rotary game table 2 such that the vertical thickness of the rotary game table 2 is greatly reduced. This design has no effect on the recreation because the fan 4 is not used when the user plays table soccer.

Figure 4:
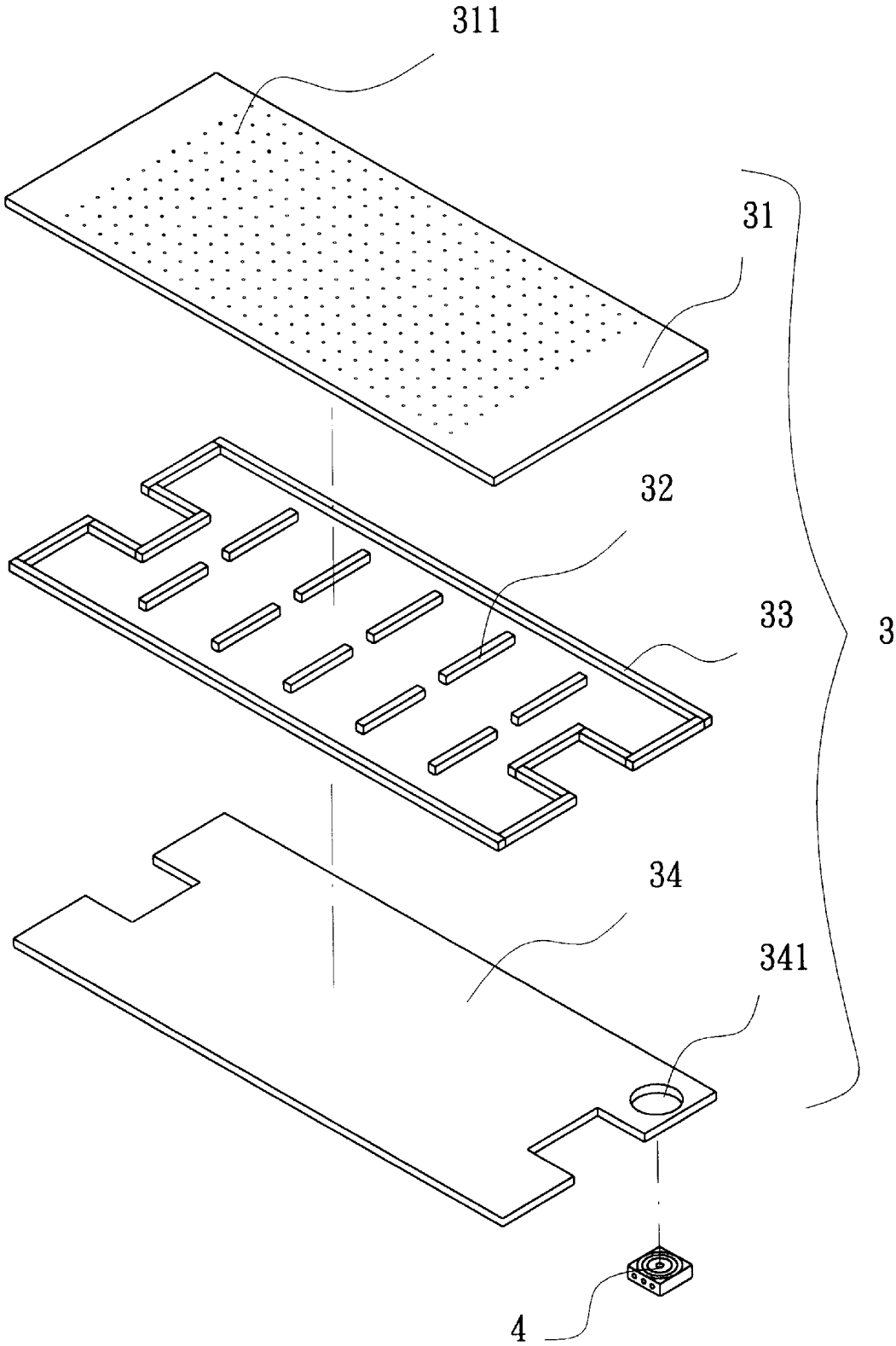
FIG. 4 is an exploded diagram of the game table plate according to the present invention.

With reference FIG. 4, the game table plate 3 needs a special design because the game table plate for hockey table is on the other side. The game table plate 3 comprises a hockey plate 31, a plurality of baffle plates 32, a plurality of frame plates 33, and a soccer plate 34 stacked in sequence. The hockey plate 31 has a plurality of fine pores 311. An air inlet 341 is at one of the four corners of the soccer plate 34. The fan 4 is mounted at that place (as the back of the air inlet 341 in FIG. 4). The air stream is driven by the fan 4 when triggered to pass through the air chamber between the baffle plates 32 and the frame plates 33, and finally inject into the fine pores 311 on the hockey plate 31. Thus, the air injected from the fine pores 311 forms floating stream to float the ball on the hockey plate 31 such that the user can hit the ball into the goal.

In the embodiment of the present invention, only one fan 4 is placed on one of the four corners of the soccer plate 34, but additional fans may be mounted on other tree corners according to actual requirement. Some respective structures are needed to allow for sufficient air stream to float the ball and also hidden in other goal frames 24. The above designs are all within the scope of the present invention.

As shown in FIG. 3, the game table base 1 primarily used to support the rotary game table 2 includes a pivot axis 11 inserted into the axis holes 21 of the rotary game table 2 so as to more smoothly rotate game table. Two opposite sides of the game table base 1 with respect to the pivot axis 11 have two position holes 12 and four position holes 22. A fix device in the game table base 1 is used to tightly lock with. The fix device is similar to a screw and makes sure the game table base 1 and the rotary game table 2 are tightly locked. A plurality of movable rods 23 are mounted on the sides of the rotary game table 2 with table soccer to control the position and rotation of the puppets so as to achieve the purpose of recreation. The goal bases 14 on the two sides of the game table base 1 are the goals for hockey table.

The rotary game table 2 of the present invention is implemented by a rotary design and has a support structure of the bottom base with special design. There are a plurality of movable rods 23 mounted on the side of the rotary game table 2 with table soccer and thus the ratio of the height of the rotary game table 2 to the elongation length of each movable rod 23 is a constant. Two factors should be noted in the design of the game table machine: firstly, the game table base requires appropriate rigidity; secondly, the movable rods can not touch the bottom structure. Therefore, the present invention uses two support skeletons 13, each support skeleton having two arc sides 12. For the traditional design of one support skeleton placed at the middle, some of the movable rods 23 in vertical state may touch the bottom structure when the rotary game table rotates. This problem is overcome in the present invention because there are two support skeletons 13 on both sides and the arc of each arc side 12 can coordinate with the rotating radius of each movable rod 23. A store box 15 between the two arc sides 12 may store desired stuffs in order to increase the practice.

From the above description, the improved air system of the rotary game table in accordance with the present invention has the following advantages:

1. The fan 4 of the rotary game table 2 is hidden in the goal frame 24 of another side so as to greatly reduce the vertical thickness of the game table machine and also the manufacturing cost. Additionally, it becomes easier to manufacture the game table machine. The material desired is less such that the delivery cost is reduced and the potential of competition in the market is enhanced.
2. It is convenient to switch to another game on the bottom side by only directly rotating the game table.
3. One single game table machine has two different games at lower cost and with less space.

Although only the preferred embodiments of this invention were shown and described in the above description, it is requested that any modification or combination that comes within the spirit of this invention be protected.

What is claimed is:

1. A game table machine with an improved air system of a rotary game table, comprising:

a game table base;

a rotary game table, pivoted on said game table base with an axis rod, and comprising a table soccer and hockey table;

a game table plate, comprising a table soccer plate, a plurality of baffle plates, a plurality of frame plates, and a hockey table plate which are stacked in sequence, said hockey table plate having a plurality of fine pores, said table soccer plate having an air inlet on at least one of four corners, and a fan located on said corner; and two goal frames, located on two sides of said table soccer plate, respectively, each goal frame comprising a goal, a plurality of baffle plates in said goal frame to separate a location for said goal, and one of said baffle plates in said goal frame having a plurality of air holes which are faced to said fan;

wherein said fan is hidden in said goal frame of the rotary game table, and said goal is used as a passing channel for incoming air from said air inlet, thereby reducing a vertical thickness of said rotary game table.

2. The game table machine as claimed in claim 1, wherein said game table base comprises two support skeletons, each support skeleton having a plurality of arc sides, each arc side coordinated with a rotating radius of movable rods, and each movable rod mounted on two sides of the rotary game table for said table soccer.

3. The game table machine as claimed in claim 1, wherein said goal frame comprises a ball outlet.

4. The game table machine as claimed in claim 1, wherein said table soccer plate may have more than one air inlet and fan on the four corners when said rotary game table is larger, and more than one air inlet is formed in one baffle plate of a respective goal frame to provide air stream as desired.

* * * * *